United States Patent [19]

Young

[11] 4,127,469

[45] Nov. 28, 1978

[54] OIL SHALE RETORTING PROCESS

[75] Inventor: Dean A. Young, Yorba Linda, Calif.

[73] Assignee: Union Oil Company of California, Los Angeles, Calif.

[21] Appl. No.: 826,321

[22] Filed: Aug. 22, 1977

[51] Int. Cl.[2] ..... C10G 1/02

[52] U.S. Cl. ..... 208/11 R; 201/20; 208/253

[58] Field of Search ..... 201/20; 208/11 R, 253

[56] References Cited

U.S. PATENT DOCUMENTS

| | | | |
|---|---|---|---|
| 1,773,839 | 8/1930 | Zieley | 201/20 |
| 3,804,750 | 4/1974 | Myers et al. | 208/253 |

*Primary Examiner*—Herbert Levine

*Attorney, Agent, or Firm*—Gregory F. Wirzbicki; Lannas S. Henderson; Richard C. Hartman

[57] ABSTRACT

The concentration of arsenic in shale oil produced from retorting arsenic-containing oil shale in a conventional retorting kiln is reduced by blending with said oil shale a nickel-containing additive. During retorting, the amount of arsenic released in vaporous form from the oil shale is reduced, thereby decreasing the amount of arsenic which collects with the produced liquid shale oil. Thus, a shale oil is produced having a significantly lower arsenic content than is obtainable without the use of the nickel additive.

8 Claims, 1 Drawing Figure

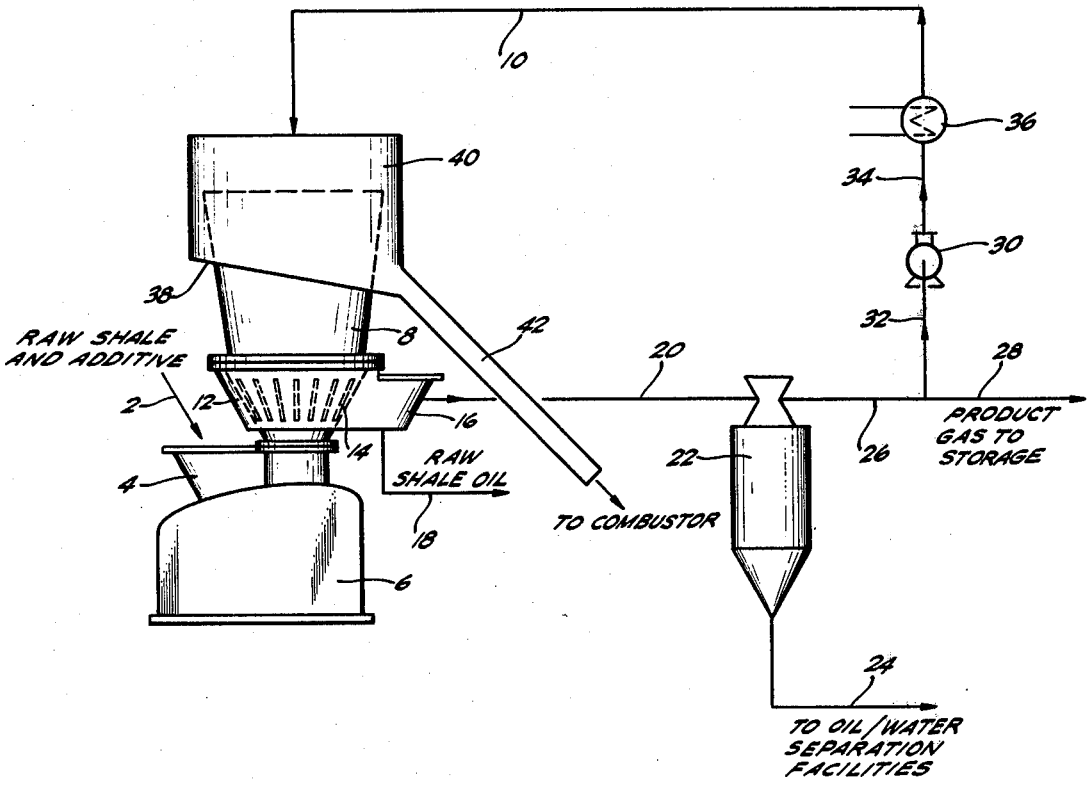
10
36
40
34
30
38
32
RAW SHALE
AND ADDITIVE
8
42
20
28
2
12
16
PRODUCT
GAS TO
STORAGE
14
RAW
SHALE OIL
22
26
4
TO COMBUSTOR
18
6
24
TO OIL/WATER
SEPARATION
FACILITIES

OIL SHALE RETORTING PROCESS

BACKGROUND OF THE INVENTION

This invention relates generally to a process for the treatment of oil-containing or oil-producing solids to extract fuel gases and liquid crude oil products therefrom. More particularly, the invention relates to a process for retorting arsenic-containing oil shale so as to produce a liquid shale oil which has a significantly lower arsenic content.

Vast deposits of oil shale, a sedimentary inorganic rock containing about 35 weight-percent calcite ($CaCO_3$), 15 weight-percent dolomite ($MgCO_3$.-$CaCO_3$), and 10 weight-percent alkali metal salts are known to exist in the United States, especially in the Green River formation in Colorado, Utah, and Wyoming. The oil shale in these deposits contains between 5 and 35 weight-percent of hydrocarbons in a form known as kerogen. When pyrolized, this kerogen decomposes to produce crude shale oil vapors, which, upon condensation, become a valuable source of fuel.

Several pyrolytic processes have heretofore been developed to produce crude shale oil from oil shale. One such process is shown in U.S. Pat. No. 3,361,644, which is incorporated herein by reference. In this process oil shale is fed upwardly through a vertical retort by means of a reciprocating piston. The upwardly moving oil shale continuously exchanges heat with a downwardly flowing, high-specific-heat, hydrocarbonaceous recycle gas introduced into the top of the retort at about 1200° F. In the upper section of the retort (the pyrolysis zone), the hot recycle gas educes hydrogen and hydrocarbonaceous vapors from the oil shale. In the lower section (the preheating zone), the oil shale is preheated to pyrolysis temperatures by exchanging heat with the mixture of recycle gas and educed hydrocarbonaceous vapors plus hydrogen. Most of the heavier hydrocarbons condense in this lower section and are collected at the bottom of the retort as a product oil. The uncondensed gas is then passed through external condensing or demisting means to obtain more product oil. The remaining gases are then utilized as a product gas, a recycle gas as hereinbefore described, and a fuel gas to heat the recycle gas to the hereinbefore specified temperature of 1200° F.

A problem with this and all similar oil shale retorting processes is that, during retorting, arsenic components present in oil shale either sublime to or are pyrolyzed into vaporous arsenic-containing components. As a result, arsenic in various forms collects with the educed hydrocarbonaceous vapors and condense with the heavier hydrocarbons in the preheating zone, or, in some processes, in a condenser situated outside of the retorting vessel. When oil shale obtained from the Green River formation is retorted, the concentration of arsenic in the produced crude shale oil is usually in the range of 30–80 ppmw. But since crudes containing such high concentrations of arsenic present problems in refining, especially with respect to poisoning hydrocarbon conversion catalysts used in catalytic cracking, hydrotreating, hydrocracking, reforming, etc., and since such oils also present an obvious pollution problem if burned without refining, the necessity for removing the arsenic from crude shale oil, or preventing its formation as vaporous components in the retorting zone, is clear.

However, presently available methods devised to produce an arsenic-free shale oil involve removing the arsenic from the liquid shale oil obtained from the retort. One such method is shown in my U.S. application Ser. No. 700,017 filed June 25, 1976, now U.S. Pat. No. 4,046,674 wherein arsenic-containing shale oil is contacted with an absorbent containing nickel sulfide, molybdenum sulfide, and alumina, under conditions of elevated pressure and temperature so as to obtain an arsenic-free shale oil. But although such a process is effective for removing arsenic from shale oil, it obviously would be more desirable to prevent the formation, or to minimize the amount, of vaporous arsenic components produced in the retorting zone. But no process for producing such a result is commercially available.

SUMMARY OF THE INVENTION

According to this invention, crushed oil shale about to be retorted in a conventional oil shale retort is admixed with at least sufficient of a nickel component additive so that in the resulting mixture of oil shale and additive the proportion of added nickel, as the metal, is at least 5 ppmw. When the mixture is fed to a retort wherein kerogen in the oil shale is pyrolyzed in a retorting zone at temperatures above about 600° F. to release shale oil vapors, the amount of vaporous arsenic also released in the retorting zone is reduced. Thus, the concentration of arsenic that will be present in the produced shale oil is reduced, with the concentration of arsenic in said shale oil decreasing with increasing proportions of added nickel in the shale-additive mixture fed to the retort.

As used herein, the terms "arsenic" and "arsenic components" are interchangeable and are intended to include arsenic in whatever form, elemental or combined, it may be present. Also, all oil shale and shale oil arsenic concentrations are herein calculated as elemental arsenic. Lastly, as herein calculated, the proportion of nickel additive in shale-additive mixtures is based on the weight of added nickel.

BRIEF DESCRIPTION OF THE DRAWING

The drawing shows a typical shale oil retort or retorting kiln in which a mixture comprising crushed oil shale and a nickel additive is passed countercurrently with an eduction gas through a retorting zone. Shale oil vapors released in the retorting zone are condensed in the preheating zone as an arsenic-free liquid shale oil.

DETAILED DESCRIPTION OF THE INVENTION

Any of a large number of naturally occurring, arsenic-containing, oil-producing solids can be used in this process. Typical of such solids are oil shales derived from the Green River formation, which usually contain 45–70 ppmw arsenic, or oil shales obtained from Morocco, which usually contain 10–20 ppmw arsenic. Regardless of the source of arsenic-containing shale, however, the shale should, for practical purposes, contain at least about 10, preferably at least 20, and usually between about 20 and about 80 gallons of oil per ton of raw shale by Fischer assay. Such shales when retorted will yield sufficient shale oil to justify the costs involved in retorting.

Referring now to the drawing, an arsenic-containing oil shale, crushed to particles no greater than 6 inches mean diameter, and preferably to particles no greater than 3 inches mean diameter, is fed at 2 with a nickel-containing additive into hopper 4 of shale feeder 6, the details of which shale feeder 6 are described in more detail in U.S. Pat. No. 3,361,644. The shale-additive mixture is forced upwardly by shale feeder 6 into retort 8 at a rate in excess of about 100, and preferably between about 400 and 2000, pounds per hour per square foot of cross-sectional area in the retort. These values refer to the average cross-sectional areas in the tapered retort illustrated in the drawing.

In retort 8, the shale-additive mixture traverses a preheating zone in the lower portion of retort 8 and a retorting (or pyrolysis) zone in the upper portion of retort 8. As the shale progresses upwardly through the retort, its temperature is gradually increased to retorting levels by a countercurrently flowing eduction gas comprising a preheated recycled portion of retort product gas from line 10. This product gas, and hence also the recycle gas, are of high BTU content, generally between about 700 and 1000 BTU/Ft$^3$, and also of high specific heat, usually between about 14 and 18 BTU/mol/° F. Eduction temperatures in the retorting zone are conventional, usually in excess of about 600° F., and preferably between about 900° and about 1200° F. Essentially all of the oil will have been educed from the shale by the time it reaches a temperature of about 900° F. Gas temperatures above about 1300° F. in the retorting zone should not be exceeded since they result in excessive shale oil cracking. Other retorting conditions include shale residence times in excess of about 10 minutes, usually about 30 minutes to about one hour, sufficient to educe the desired amount of oil at the selected retort temperatures.

Pressure in retort 8 may be either subatmospheric, atmospheric, or superatmospheric. Retorting pressures normally exceed about 0.3 and are preferably between about 5 and about 1000 psia. The recycle gas is introduced via line 10 at a temperature and flow rate sufficient to heat the crushed shale to retorting temperatures. Heat transfer rates depend in large part on the flow rate, temperature, and heat capacity of this recycle gas. Flow rates of at least about 3000, generally at least about 8000, and preferably between about 10,000 and about 20,000 SCF of recycle gas per ton of raw shale feed are employed. The temperature differential between the recycle gas and solids at the top of the retorting zone is usually between 10° and 100° F. Excessive temperature differentials, e.g., in excess of about 400° F., should be avoided.

As the recycle gas from line 10 passes downwardly through retort 8, it continuously exchanges heat with the upwardly moving oil shale-additive mixture. In the upper portion of retort 8 oil contained within the oil shale is educed therefrom by pyrolysis, thereby producing shale oil vapors and fuel product gases comprising such normally uncondensable gases as methane, hydrogen, ethane, etc. These shale oil vapors and fuel product gases pass downwardly with the recycle gas, firstly into the lower portion (preheating zone) of retort 8 wherein the cool oil shale-additive mixture condenses the shale oil vapors, and thence into a frusto-conical product disengagement zone 12. This disengagement zone comprises peripheral slots 14 through which liquid shale oil and product gases flow into surrounding product collection tank 16. The liquid shale oil is withdrawn therefrom at a rate between about 5 and 60 gallons/ton of raw shale feed via line 18, while the aforementioned product gases at a temperature between about 80° and 300° F. are withdrawn via line 20.

The product gases are introduced into conventional venturi scrubber 22 wherein a liquid scrubbing medium is used to remove any remaining traces of water, shale oil vapors, and shale oil mist contained therein. The liquid scrubbing medium, after absorbing water and shale oil, is then sent via line 24 to conventional shale oil-water separation facilities (not shown), while the dry product vapors are sent to storage via lines 26 and 28 at a rate of 11,000 to 21,000 SCF/ton of shale feed. A portion of the product gases obtained in line 26 are passed by blower 30 and lines 26, 32, and 34 to preheater 36, wherein this portion of the product gases is heated to a temperature sufficient for retorting purposes in retort 8.

As product vapors are removed from retort 8 via line 20, the retorted oil shale overflowing the top of retort 8 falls onto inclined peripheral floor 38 of shroud 40, which is affixed in fluid-tight fashion to the outer wall of the retort. The retorted shale, now at a temperature between about 900° and 1300° F., preferably between about 900° and 1100° F., then gravitates down floor 38 into chute 42. From chute 42 the retorted shale may, by facilities not shown, be passed to a combustor wherein coke on said retorted shale is burned to produce a heated flue gas for use as a heat exchange medium in preheater 36. Alternatively, the retorted shale may be contacted with steam to further remove shale oil or product gas vapors. And alternatively still, the retorted shale may simply be discharged to a waste ash heap.

The critical feature of the invention as thus far described is the addition of a nickel-containing additive with the oil shale entering the retort. To obtain uniform distribution and intimate contacting of additive and shale rock, the additive is preferably introduced into the raw shale by spraying a solution of a nickel component into the shale particles about to be fed into hopper 4. The solution sprayed onto the shale particles should, in accordance with the invention, contain at least 0.10 grams of nickel per liter, and preferably at least 0.50 grams of nickel per liter. It is most highly preferred, however, that the solution contain between about 1 and 10 grams of nickel per liter.

The solutions of nickel components suitable herein may be organic or inorganic in nature. However, aqueous solutions of inorganic nickel compounds, such as aqueous solutions of such highly water-soluble nickel compounds as nickel chloride, nickel nitrate, and nickel sulfate, are preferred. Suitable aqueous solutions include aqueous, ammoniacal solutions of basic nickel carbonate ($NiCO_3.2Ni(OH)_2.4H_2O$), and other aqueous solutions in which a water-insoluble nickel compound (or nickel itself is dissolved.

In the preferred mode of operation, the shale particles are sprayed so as to just wet the surfaces thereof with the aqueous, nickel-containing solution. Preferably, the resulting mixture of oil shale and additive contains at least 5 ppmw of added nickel, and most preferably between about 10 and 100 ppmw of added nickel. When the shale is so treated, and is then subjected to retorting in retort 8, the amount of arsenic released from said shale in vaporous forms is substantially reduced. Thus, the amount of arsenic which will collect with the produced shale oil will be minimized, and the concentration of arsenic in said shale oil is substantially less than that obtainable when no additive is utilized. For a typical shale obtained from the Green River formation, a reduction in the concentration of arsenic in the produced shale oil of at least 30% is obtainable when the oil shale contains about 15 ppmw of added nickel. And when the same shale contains higher proportions of added nickel, the concentration of arsenic in the produced shale oil is reduced still further, often by at least 75%, with the reduction of arsenic in the shale oil increasing with the increased proportions of added nickel.

The following example is provided to illustrate the invention.

EXAMPLE

Three 751-gram samples of oil shale obtained from the Green River formation in Colorado were crushed to less than ⅜-inch mean diameter granules. One sample was wetted with an ammoniacal solution of nickel carbonate (0.018 grams $NiCO_3.2Ni(OH)_2.4H_2O$ in 50 ml of 1.0 N $NH_4OH$) so that the shale-additive mixture contained 11 ppmw nickel (as nickel). A second sample was wetted with aqueous nickel nitrate (0.0438 grams $Ni(NO_3)_2.6H_2O$ in 10 ml water) so that the shale-additive mixture contained 12 ppmw nickel (as nickel). The third sample was admixed with no additive.

The following experiment was then performed on each sample individually. The sample was supported as a 16-inch column in a 2-inch diameter, 5-foot long, stainless steel tube. A synthetic retort product gas, dehydrated to a water vapor dewpoint of 100° F., and consisting, on a dry basis, of 28.3 mole percent $H_2$, 50.0 mole percent $CH_4$, 2.3 mole percent $H_2S$, 7.0 mole percent CO, and 12.5 mole percent $CO_2$, was then passed downwardly through the tube. The tube itself was gradually pushed upwardly through a furnace maintained at about 1000° F. such that any gradient of shale in the tube took 1 hour to heat up to 1000° F. and was maintained at 1000° F. for 1 hour. The educed shale oil vapors were condensed in a condenser situated external to the stainless steel tube, and the collected shale oil was analyzed for arsenic. These data and other data obtained in the three experiments are recorded in the following Table.

TABLE

| Test No. | 1 | 2 | 3 |
|---|---|---|---|
| Additive Solution | None | $NiCO_3 . 2Ni(OH)_2$ | $Ni(NO_3)_2$ |
| Added Nickel in mixture, ppmw | 0 | 11 | 12 |
| Collected Shale Oil gm | 67 | 67 | 84 |
| Arsenic in collected shale oil after filtration ppmw | 13 | 7.1 | 8.6 |
| Arsenic in collected shale oil after filtration and extraction in 2 N $NH_4OH$ | 8.2 | 6.1 | 5.2 |

Although the invention has been described in conjunction with a specific example thereof, it is evident that many alterations, modifications, and variations will be apparent to those skilled in the art in light of the foregoing description. Accordingly, it is intended to embrace all such alternatives, modifications, and variations that fall within the spirit and scope of the appended claims.

I claim:

1. In a process for retorting arsenic-containing oil shale wherein a stream of oil shale particles is passed with an eduction gas through a retorting zone at elevated temperatures so as to educe shale oil vapors from said oil shale particles, which shale oil vapors are subsequently condensed and collected as liquid shale oil, the improvement comprising subjecting said arsenic-containing oil shale particles to elevated temperatures in said retorting zone in the presence of a nickel-containing additive so as to reduce the amount of arsenic present in the gases obtained from said retorting zone, thereby reducing the proportion of arsenic in the liquid shale oil product subsequently recovered by condensation.

2. A process as defined in claim 1 wherein said additive is selected from the class consisting of nickel nitrate, nickel sulfate, nickel carbonate, and nickel chloride, said additive having been blended with said oil shale particles prior to said retorting by spraying an aqueous solution of said additive onto said oil shale particles.

3. A process as defined in claim 2 wherein said aqueous solution is an ammoniacal solution of nickel carbonate.

4. A process comprising:

(a) admixing arsenic-containing oil shale particles and a nickel-containing additive to produce an oil shale-additive mixture;

(b) passing said mixture and an eduction gas through a retorting zone maintained at a temperature of at least about 600° F., said mixture being passed through said retorting zone at a rate sufficient to educe shale oil vapors from said mixture;

(c) withdrawing from said retorting zone a gas of reduced arsenic content comprising said eduction gas and shale oil vapors;

(d) condensing said shale oil vapors into a liquid shale oil containing arsenic in a concentration lower than that obtainable by retorting said oil shale particles alone under the same conditions.

5. A process as defined in claim 4 wherein said additive is selected from the class consisting of nickel nitrate, nickel sulfate, nickel carbonate, and nickel chloride, said additive having been blended with said oil shale particles in step (a) by spraying an aqueous solution of said additive onto said oil shale particles.

6. A process as defined in claim 5 wherein said aqueous solution is an ammoniacal solution of nickel carbonate.

7. A process as defined in claim 4 wherein said additive is present in said mixture of oil shale particles and additive in a proportion of at least 5 ppmw as added nickel metal.

8. A process as defined in claim 7 wherein said proportion is between about 10 and 100 ppmw.

* * * * *